1/28/86 4,566,878

United States Patent [19]

Karol et al.

[11] Patent Number: 4,566,878

[45] Date of Patent: Jan. 28, 1986

[54] REACTION PRODUCT OF BETA-MERCAPTOETHANOL AND COCONUT OIL AS DIESEL FUEL ANTIWEAR ADDITIVE

[75] Inventors: Thomas J. Karol, Norwalk, Conn.; Rodney L. Sung, Fishkill, N.Y.

[73] Assignee: Texaco Inc., White Plains, N.Y.

[21] Appl. No.: 710,650

[22] Filed: Mar. 11, 1985

[51] Int. Cl.[4] ..... C10L 1/24

[52] U.S. Cl. ..... 44/57; 44/66; 44/70

[58] Field of Search ..... 44/57, 66, 70

[56] References Cited

U.S. PATENT DOCUMENTS 3,667,152 6/1972 Eckert ..... 44/66

4,364,743 12/1982 Erner ..... 44/66

*Primary Examiner*—Y. Harris-Smith

*Attorney, Agent, or Firm*—Robert A. Kulason; James J. O'Loughlin; Vincent A. Mallare

[57] ABSTRACT

A diesel fuel, containing the reaction product of Beta-mercaptoethanol and coconut oil, is characterized by improvement in anti-wear properties.

20 Claims, No Drawings

REACTION PRODUCT OF BETA-MERCAPTOETHANOL AND COCONUT OIL AS DIESEL FUEL ANTIWEAR ADDITIVE

FIELD OF INVENTION

This invention relates to middle distillates of improved wear resistance. More particularly it relates to diesel fuels of improved wear performance.

BACKGROUND OF INVENTION

As is well known by those familiar with diesel engines and their performance, diesel fuels generally do not possess the ability to lubricate surfaces and to minimize the wear of the injectors of diesel engines.

Great concern has been expressed by original equipment manufacturers over the wear seen in the upper cylinder of internal combustion engines, particularly, diesel engines. An example which illustrates this concern is the Ford Tornado Diesel Engine test which measures the extent of "scuffing" and "polishing" seen in the upper cylinder. It is apparent that lubricating oils can influence this wear, especially on the downward stroke when the oil has contacted the cylinder wall where the motion will occur.

If the fuel can be made to perform as a better lubricant it is possible to obtain further improvement. Since there is an upward compression stroke with the diesel fuel present, the more of a protective lubricant this fuel is, the better the performance of the diesel engine.

The fuel is injected prior to the compression stroke. During the compression stroke, the fuel is the lubricant for the motion since it is in contact with the cylinder wall which will undergo the contact motion. This is prior to the ignition of the fuel. It is reasonable to believe that the majority of wear seen in the upper cylinder comes from the upward motions of the piston since the cylinder wall section is not lubricated relative to the downward motion where oil should have had contact.

Thus, an object of this invention is to provide a diesel fuel having improved wear resistant properties. Other objects will be apparent from the following discussion.

STATEMENT OF THE INVENTION

This invention is directed to a middle distillate fuel oil composition characterized by wear resistance which comprises:

a major portion of a middle distillate fuel oil; and a minor effective portion of an additive prepared by reacting Beta-mercaptoethanol with coconut oil.

DESCRIPTION OF THE INVENTION

The compositions employed according to the present invention may include a hydroxy hydrocarbyl mercapto ester of a $C_1$–$C_{40}$ fatty acid.

The fatty acids may be caprylic, capric, lauric, myristic, palmitic, stearic, oleic or linoleic.

The fatty acid moiety is represented by the formula:

RCOO— wherein R is a hydrocarbon group selected from the group consisting of alkyl, aralkyl, cycloalkyl, aryl, alkaryl, alkenyl, and alkynyl including such radicals when inertly substituted.

In the above compound, when R is alkyl, it may be methyl, ethyl, n-propyl, iso-propyl, n-butyl, i-butyl, sec-butyl, amyl, octyl, decyl or octadecyl. When R is aralkyl, it may be benzyl or beta-phenylethyl. When R is cycloalkyl, it may be cyclohexyl, cycloheptyl, cyclooctyl, 2-methylcycloheptyl, 3-butylcyclohexyl or 3-methylcyclohexyl. When R is aryl, it may be phenyl or naphthyl. When R is alkaryl, it may be tolyl or xylyl. When R is alkenyl, it may be vinyl, allyl or 1-butenyl. When R is alkynyl, it may be ethynyl, propynyl or butynyl. R may be inertly substituted, i.e. it may bear a non reactive substituent such as alkyl, aryl, cycloalkyl, ether, halogen or nitro. Typically inertly substituted R groups may include 3-chloropropyl, 2-ethoxyethyl, carboethyoxymethyl, 4-methyl cyclohexyl, p-chlorophenyl, p-chlorobenzyl or 3-chloro-5-methylphenyl. The preferred R groups may be a $C_6$–$C_{20}$ alkyl, more preferably a $C_{12}$–$C_{16}$ alkyl and most preferably a $C_{12}$ alkyl group.

In one aspect of this invention, the fatty acid moiety may be derived from various commercially available fats and oils such as those set forth in the following table:

TABLE

| | |
|---|---|
| Coconut | Peanut |
| Babassu | Rape |
| Palm kernel | Beef Tallow |
| Palm | Lard |
| Olive | Whale blubber |
| Castor | |

Of such fats and oils, the preferred is coconut oil which contains residues of the following acids:

TABLE

| Component | Wt. % |
|---|---|
| Caprylic | 8.0 |
| Capric | 7.0 |
| Lauric | 48.0 |
| Myristic | 17.5 |
| Palmitic | 8.2 |
| Stearic | 2.0 |
| Oleic | 6.0 |
| Linoleic | 2.5 |

The hydroxy hydrocarbyl mercapto moiety in the ester, characterized by the formula HOS'S—may be derived from a mercapto alcohol HOR'SH.

In the above compound, R' may be a divalent hydrocarbon selected from the group consisting of alkylene, aralkylene, cycloalkylene, arylene, alkarylene, alkenylene, and alkynylene including such radicals when inertly substituted. When R' is alkylene, it may be methylene, ethylene, n-propylene, iso-propylene, n-butylene, i-butylene, sec-butylene, amylene, octylene, decylene or octadecylene. When R' is aralkyl, it may be benzylene or beta-phenylethylene. When R' is cycloalkylene, it may be cyclohexylene, 1-cycloheptylene, cyclooctylene, 2-methylcycloheptylene, 3-butylcyclohexylene or 3-methylcyclohexylene. When R' is arylene, it may be phenylene or naphthylene. When R' is alkarylene, it may be tolylene, or xylylene. When R' is alkenylene, it may be propylene tetramer or isobutylene tetramer. When R' is alkynylene, it may be ethynylene, propynylene or butynylene. R' may be inertly substituted, i.e. it may bear a non-reactive substituent such as alkyl, aryl, cycloalkyl, ether, halogen or nitro. The inertly substituted R' groups may include 3-chloropropylene, 2-ethoxyethylene, carboethoxymethylene, 4-methyl cyclohexylene, p-chlorophenylene, p-chlorobenzylene or 3-chloro-5-methylphenylene. The preferred R' groups may be lower alkylene, i.e. $C_1$–$C_{10}$ alkylene groups such as methylene, ethylene, n-propylene, i-propylene, butylene, amylene, hexylene, octylene or decylene. R preferably is $—CH_2—CH_2$.

The mercaptoalcohols which may be used in the practice of this invention (as their ester with the acids listed above) are Beta-mercaptoethanol, Gamma-mercaptopropanol, Beta-mercapto-i-propanol, and Delta-mercapto-n-butanol.

The reaction between the acid and alcohol may be effected by direct reaction of the acid and the alcohol under esterification reaction conditions. In the preferred embodiment the reaction (a saponification or transesterification) may be effected by heating the oil and e.g. coconut oil (an ester) with mercapto alcohol in the presence of an esterification catalyst. The amount of acid-bearing moiety (e.g. the coconut oil in the preferred embodiment) may be sufficient to yield 0.1 to 1.0 mole of acid bearing moiety per mole of thioalcohol. Although the oil may be present in an amount sufficient to yield acid-bearing moieties at the lower end of the noted range (in which instance unreacted thioalcohol would be removed by distillation during the reaction), it is preferred that the oil be present in amount to yield acid-bearing moieties substantially equivalent to the thioalcohol. No advantage is observed if the coconut oil is present in excess. In the preferred embodiment, the oil is present in an amount substantially equivalent to that of the thioalcohol. Esterification may be effected by heating at 100° C.-160° C., say 150° C. for 2-24 hours, say 4 hours (to remove by-product water). The product may be employed as so prepared.

The esters which may be employed include those represented by the formula RCO—SR'OH. Illustrative esters may include those set forth in the following Table:

TABLE

| |
|---|
| $C_{10}H_{21}COSCH_2CH_2OH$ |
| $C_{11}H_{23}COSCH_2CH_2OH$ |
| $C_{12}H_{25}COSCH_2CH(CH_3)OH$ |
| $C_{14}H_{29}COSCH_2CH_2CH_2OH$ |
| $C_9H_{19}COSCH_2CH_2OH$ |

The preferred ester may be that prepared by reacting substantially equimolar quantities of coconut oil fatty acids and Beta-mercaptoethanol, as represented by the following equation:

$$RCHOOH + HSCH_2CH_2OHRCOSCH_2CH_2OH$$

wherein R contains residues of the coconut oil acids noted above. This may be achieved for example by reacting one mole of coconut oil with three moles of thioalcohol.

It is a feature of this invention in certain of its aspects that the desired mercaptoesters may be prepared by the reaction of a fat or fatty oil typified by those set forth in the Table supra with the mercaptoalcohol. In accordance with certain of its aspects, this invention is directed to a method which comprises reacting (i) a mercaptoalcohol and (ii) a polyester of a polyhydroxy alcohol thereby transesterifying said polyester of said polyhydroxy alcohol and forming product mercaptoester of said mercapto alcohol; and recovering said product mercapto ester of said mercapto alcohol. This transesterification may be typically as follows:

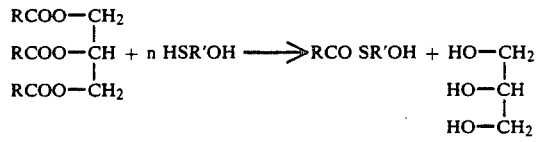

The reaction may be carried out at 100° C. to 160° C., preferably at 150° C., for 2-24 hours, preferably for 4 hours, in the presence of a transesterification catalyst such as calcium oxide, calcium hydroxide, toluene sulfonic acid, potassium hydroxide or methane sulfonic acid. The product may be employed as prepared; and the hydroxy-containing by-product (including glycerine in the illustrative example) need not be separated.

It is a feature of this invention that these thioester additives may be added to a major portion of a middle distillate fuel as a minor effective portion of 0.001-2.0 wt. %, preferably 0.01-1.0 wt. %, and more preferably about 0.025 wt. %.

The middle distillate fuel compositions to which these products may be added include hydrocarbon liquids having an ibp of 300° F.-430° F., say about 410° F., a 50% bp of 430° F.-600° F., say 517° F., a 90% bp of 510° F.-650° F., say 597° F. and an API gravity of 30-40, say 35.2. They may commonly be identified as kerosene, Avjet fuel, diesel fuel, fuel oil, home heating oil, etc. They include products having the noted boiling points recovered as cut from oils obtained by the hydrogenation of heavy oils or of solid carbonaceous fuels such as coal typified by the liquid identified as diesel fuel cut from H oil.

One preferred middle distillate may be a diesel fuel having the following properties:

TABLE

| Property | Value |
|---|---|
| API Gravity D-1298 | 37.3 |
| Kin. Vis. cSt °40° C. D-445 | 2.27 |
| Cetane D-163 | 49.6 |
| Distillation D-86 (°F.) | |
| IBP* | 369 |
| 50% | 496 |
| 90% | 586 |
| EP** | 627 |

*Initial boiling point
**End point

Another preferred charge may be a middle distillate fuel having the following properties:

TABLE

| Property | Value |
|---|---|
| API Gravity D-1298 | 43.0 |
| Kin. Vis. cSt °40° C. D-445 | 1.57 |
| Cetane D-163 | 47 |
| Distillation D-86 (°F.) | |
| IBP | 344 |
| 50% | 429 |
| 90% | 490 |
| EP | 524 |

Another preferred charge may be a No. 2 fuel oil having the following properties:

TABLE

| Property | Value |
|---|---|
| API Gravity D-1298 | 35.7 |
| Kin. Vis. cSt °40° C. D-445 | 2.40 |
| Cetane D-163 | 44.7 |

TABLE-continued

| Property | Value |
|---|---|
| Distillation D-86 (°F.) | |
| IBP | 388 |
| 50% | 510 |
| 90% | 596 |
| EP | 653 |

Another preferred charge may be a kerosene having the following properties:

TABLE

| Property | Value |
|---|---|
| API Gravity D-1298 | 43.0 |
| Kin. Vis. cSt °40° C. D-445 | 1.57 |
| Cetane D-163 | 47 |
| Distillation D-86 (°F.) | |
| IBP | 344 |
| 50% | 429 |
| 90% | 490 |
| EP | 524 |

Another preferred charge may be a diesel fuel having the following properties:

TABLE

| Property | Value |
|---|---|
| API Gravity D-1298 | 32.8 |
| Kin. Vis. cSt °40° C. D-445 | 2.22 |
| Cetane D-163 | 42.2 |
| Distillation D-86 (°F.) | |
| IBP | 356 |
| 50% | 495 |
| 90% | 610 |
| EP | 640 |

DESCRIPTION OF PREFERRED EMBODIMENTS

From the following examples, the practice of the process of this invention will be apparent to those skilled in the art. In the examples, as elsewhere in this specification, all parts are part by weight unless otherwise noted. Also, from the examples, the advantages of the present invention will be evident.

EXAMPLE I

In this example which represents the best mode known of practicing the process of this invention, the following reactants were employed:

| Reactant | grams | moles |
|---|---|---|
| Beta-mercaptoethanol | 39 | 0.5 |
| Isopropanol (50 ml) | | |
| Potassium Hydroxide | 0.5 | |
| Coconut Oil | 164 | 0.25 |

The first three reactants were charged. With agitation the coconut oil was added and the reaction mixture was heated to 100° C.–140° C. under reflux for about 19 hours. The isopropyl alcohol solvent was removed by rotary evaporation.

The product was recovered in the amount of 201 grams. Analysis of the product showed 7.2 wt. %S, a Sap. No. of 146, and a hydroxy number of 123.9.

EXAMPLE II

The same reactants were used as in Example I except that the Beta-mercaptoethanol was present in the amount of 58.6 g (0.75 moles), the isopropanol was present in the amount of 10 ml, and the potassium hydroxide was present in the amount of 0.05 g. The product was recovered in the amount of 221 grams. Analysis of the product showed 9.9%S, a Sap, No. of 126.2, and a hydroxy number of 264.

EXAMPLE III

In this example, the following reactants were employed:

| Reactant | grams | moles |
|---|---|---|
| Corn Oil | 328 | |
| 2-mercaptoethanol | 105.5 | 1.35 |
| 70% methanesulfonic acid | 0.5 | |

The reactants were charged, nitrogen blanketed, heated to 130° C., and maintained at that temperature for 5 hours. The reaction mixture was then stripped at 100° C./20 mm.Hg., cooled to room temperature, and filitered.

EXAMPLE IV

The procedure of Example III was followed using Peanut Oil in place of Corn Oil.

EXAMPLE V

The procedure of Example III was followed using Sunflower Oil in place of Corn Oil.

EXAMPLE VI

In this example, the following reactants were employed:

| Reactants | grams | moles |
|---|---|---|
| Coconut Oil | 328 | 0.5 |
| Potassium hydroxide | 0.25 | — |
| 2-mercaptoethanol | 105.3 | 1.35 |

The reactants were charged, nitrogen blanketed, heated to 150° C., and maintained at that temperature overnight (approx. 12 hours). The reaction was stripped at 100° C./20 mm. Hg., cooled to room temperature, and filtered.

The products of Examples III–VI were analyzed as provided in the Table below:

TABLE

| Example | % S (x-ray) | Tan (ASTM D- 974) |
|---|---|---|
| III | 9.9 | 21.6 |
| IV | 9.2 | 20.4 |
| V | 9.3 | 20.5 |
| VI | 6.9 | 30.1 |

THE FOUR BALL WEAR TEST

The Four Ball Wear Test (FBWT) is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 40 kilograms. The assembly is submerged in the liquid to be tested. The test is carried out at 200° F. for 60 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

The FBWT results are presented below. These results clearly show a reduction in wear in diesel fuel due to the thioester additive present when compared to wear results on the diesel fuel alone. This test also indicates that the additive is effective at 0.025 weight percent or somewhat lower, but it must be pointed out that only one addition of additive is run during the FBWT. In contrast, the diesel fuel would be continuously injected with new additive present. One could expect dramatically lower active concentrations to be effective in the fuel due to this continuous addition of new additive.

FOUR BALL WEAR TEST RESULTS IN D-2 DIESEL FUEL

In order to show the effect of the additive of the present invention, serveral concentrations were used in a D-2 Diesel Fuel and compared with a sample not containing the present additive. The conditions of the tests were: 1 hour, 200° F., a 40 kg load, and 1800 RPM.

Wear results are reported as a scar diameter (mm). The Test results of various concentrations of the additive, i.e., the reaction product of Beta-mercaptoethanol and coconut oil in D-2 Diesel Fuel are listed as follows:

| Wt. % of Additive In D-2 Diesel Fuel | Scar Diameter in MM |
|---|---|
| 0.050 | 1.168 |
| 0.025 | 1.067 |
| 0.01 | 1.803 |
| 0.000 | 1.981 |

From the above Table, it is apparent that the additive of this invention permits attainment of improvement of 46% over the base fuel.

Comparable results may be attained if the thioalcohol is:

| Example | Alcohol |
|---|---|
| VII | Gamma-mercaptopropanol |
| VIII | Beta-mercapto-i-propanol |
| IX | Delta-mercapto-n-butanol |

Comparable results may be attained if the fatty acid thioester is

| Example | Fatty Thioester |
|---|---|
| X | $R-\overset{O}{C}-S-CH_2-CH_2-CH_2-OH$ |
| XI | $R-\overset{O}{C}-S-CH_2-\overset{CH_3}{CH}-OH$ |

-continued

| Example | Fatty Thioester |
|---|---|
| XII | $R-\overset{O}{C}-S-CH_2CH_2-CH_2-CH_2-OH$ |

Although this invention has been illustrated by reference to specific embodiments, it will be apparent to those skilled in the art that various changes and modifications may be made which clearly fall within the scope of this invention.

What is claimed is:

1. A diesel fuel composition characterized by improved wear resistance which comprises a major portion of a diesel fuel; and a minor wear resistance portion of, as an additive, a hydroxy hydrocarbyl mercapto ester of a $C_1$–$C_{40}$ fatty acid.

2. The diesel fuel composition of claim 1, wherein said fatty acid is a $C_6$–$C_{20}$ fatty acid.

3. The diesel fuel composition of claim 1, wherein said fatty acid is a $C_{12}$–$C_{16}$ fatty acid.

4. The diesel fuel composition of claim 1, wherein said fatty acid is a $C_{12}$ fatty acid.

5. The diesel fuel composition of claim 1, wherein said fatty acid is derived from coconut oil.

6. The diesel fuel composition of claim 1, wherein said additive is a Beta-mercaptoethanol ester of a fatty acid derived from coconut oil.

7. The diesel fuel composition of claim 1, wherein said additive is a Gamma-mercaptopropanol ester of a fatty acid derived from coconut oil.

8. The diesel fuel composition of claim 1, wherein said wear resistance portion is 0.001–2.0 wt. %.

9. A diesel fuel composition comprising: (a) a major portion of a diesel fuel; and (b) a minor wear resistance portion of 0.01–1.0 wt. % of, as an additive, a hydroxy hydrocarbyl mercapto ester of a $C_1$–$C_{40}$ fatty acid derived from coconut oil.

10. The diesel fuel composition of claim 9, wherein said wear resistance portion is about 0.025 wt. %.

11. The method of improving the wear resistance of a diesel fuel which comprises adding to a major portion of a diesel fuel, a minor wear resistance portion of, as an additive, a hydroxy hydrocarbyl mercapto ester of a $C_1$–$C_{40}$ fatty acid.

12. The method of claim 11, wherein said fatty acid is a $C_6$–$C_{20}$ fatty acid.

13. The method of claim 11, wherein said fatty acid is a $C_{12}$–$C_{16}$ fatty acid.

14. The method of claim 11, wherein said fatty acid is a $C_{12}$ fatty acid.

15. The method of claim 11, wherein said fatty acid is derived from coconut oil.

16. The method of claim 11, wherein said additive comprises a Beta-mercaptoethanol ester of a fatty acid derived from coconut oil.

17. The method of claim 11, wherein said additive comprises a Gamma-mercaptopropanol ester of a fatty acid derived from coconut oil.

18. The method of claim 11, wherein said wear resistance portion is 0.001–2.0 wt. %.

19. The method of claim 11, wherein said wear resistance portion is 0.01–1.0 wt. %.

20. The method of claim 11, wherein said wear resistance portion is about 0.025 wt. %.

* * * * *